US006997587B2

(12) United States Patent
Albou

(10) Patent No.: US 6,997,587 B2
(45) Date of Patent: Feb. 14, 2006

(54) SCREENLESS ELLIPTICAL ILLUMINATION MODULE PRODUCING AN ILLUMINATION BEAM WITH CUTOFF AND LAMP COMPRISING SUCH A MODULE

(75) Inventor: Pierre Albou, Bobigny (FR)

(73) Assignee: Valeo Vision, Bobigny (FR)

( * ) Notice: Subject to any disclaimer, the term of this patent is extended or adjusted under 35 U.S.C. 154(b) by 175 days.

(21) Appl. No.: 10/422,564

(22) Filed: Apr. 24, 2003

(65) Prior Publication Data

US 2003/0202359 A1 Oct. 30, 2003

(30) Foreign Application Priority Data

Apr. 25, 2002 (FR) ..... 02 05323

(51) Int. Cl.
*F21V 7/04* (2006.01)

(52) U.S. Cl. ..... 362/516; 362/297; 362/539; 362/487; 362/545; 362/516

(58) Field of Classification Search ..... 362/511, 362/514, 539, 516, 515, 510, 296, 297, 301, 362/545, 487, 237, 548
See application file for complete search history.

(56) References Cited

U.S. PATENT DOCUMENTS

| | | | | |
|---|---|---|---|---|
| 4,722,037 A | | 1/1988 | Davis | 362/231 |
| 4,914,747 A | * | 4/1990 | Nino | 362/539 |
| 4,918,580 A | * | 4/1990 | Nino | 362/539 |
| 5,339,226 A | * | 8/1994 | Ishikawa | 362/539 |
| 5,450,294 A | * | 9/1995 | Hogrefe | 362/518 |
| 5,918,973 A | | 7/1999 | Nojiri | 362/511 |
| 6,948,836 B2 | * | 9/2005 | Ishida et al. | 362/516 |
| 2002/0186565 A1 | * | 12/2002 | Taniuchi et al. | 362/297 |

FOREIGN PATENT DOCUMENTS

| | | |
|---|---|---|
| DE | 100 19 557 A | 10/2001 |
| EP | 1 193 440 A1 | 4/2002 |
| FR | 1 319 105 | 2/1963 |
| FR | 1 320 761 A | 5/1963 |

* cited by examiner

*Primary Examiner*—Sandra O'Shea
*Assistant Examiner*—Anabel Ton
(74) *Attorney, Agent, or Firm*—Morgan & Finnegan LLP

(57) ABSTRACT

The invention proposes an illumination module (10) producing an illumination beam with cutoff, comprising, arranged from back to front along a horizontal optical axis (A—A), an elliptical reflector (12) which delimits a volume of reflection and which has an elliptical surface of reflection (18, 20), at least one light source (14) which is arranged in the vicinity of a first focus (F1) of the reflector (12), and a convergent lens (16) whose focal plane is arranged in the vicinity of the second focus (F2) of the reflector (12), characterized in that the reflector (12) has a horizontal flat surface (22), the upper face (24) of which is reflective, which delimits vertically towards the bottom the volume of reflection, and in that the flat surface (22) of the reflector (12) has a cutoff edge (28) which is arranged in the vicinity of the second focus (F2) of the reflector (12).

The invention also proposes a lamp comprising such an illumination module.

14 Claims, 3 Drawing Sheets

SCREENLESS ELLIPTICAL ILLUMINATION MODULE PRODUCING AN ILLUMINATION BEAM WITH CUTOFF AND LAMP COMPRISING SUCH A MODULE

The present invention relates to an illumination module and a motor vehicle illumination lamp.

The present invention relates more particularly to an illumination module for a motor vehicle lamp producing an illumination beam of the type with cutoff, comprising, arranged from back to front overall along a longitudinal horizontal optical axis, a reflector of the elliptical type which delimits a volume of reflection for light rays and which has a substantially elliptical surface of reflection, at least one light source which is arranged in the vicinity of a first focus of the reflector, and a convergent lens whose focal plane is arranged in the vicinity of the second focus of the reflector.

Lamps of the elliptical type, or lamps with image reproduction optics, are well known, in particular for the production of an illumination beam with cutoff.

Illumination beam with cutoff means an illumination beam which has a directional limit, or cutoff, above which the emitted light intensity is low.

Low beam headlight and fog light functions are examples of illumination beams with cutoff, in accordance with the current European legislation.

Generally, in an elliptical lamp, the cutoff is implemented by means of a screen, which is formed from a vertical plate of adapted profile, which is interposed axially between the elliptical reflector and the convergent lens, and which is arranged in the vicinity of the second focus of the reflector.

The screen makes it possible to mask the light rays originating from the light source and reflected by the reflector towards the lower part of the focal plane of the convergent lens, and which would, in the absence of the screen, be emitted by the lamp above the cutoff.

One drawback of this type of lamp is that a large part of the light energy emitted by the source is dissipated in the rear face of the screen.

The document U.S. Pat. No. 4,914,747 discloses a lamp whose reflector comprises upper and lower parts in the shape of semi-ellipsoids with the same optical axis, the second foci of which are coincident, the first focus of the upper reflector being situated in front of that of the lower reflector. The lamp comprises a bulb with two filaments, each disposed at one of the first foci of the reflectors. A flat screen is disposed parallel to the optical axis of the reflectors, the front edge of this screen being disposed in the vicinity of the second foci, themselves coinciding with the focus of a convergent lens.

The document EP-A-1 193 440 discloses a lamp producing an illumination beam of the type with cutoff, comprising a semi-elliptical reflector, a light source arranged in the vicinity of the first focus of the reflector, a convergent lens whose focal plane is arranged in the vicinity of the second focus of the reflector, and a horizontal flat surface of reflection, the upper face of which is reflective, the flat surface has a front end edge which is arranged in the vicinity of the second focus of the reflector, so as to form the cutoff in the illumination beam, the flat surface is mounted able to pivot about its rear edge so as to form a low beam when it is parallel to the optical axis, and a high beam when it is switched over.

The invention proposes an illumination module for a motor vehicle lamp producing an illumination beam of the type with cutoff, comprising, arranged from back to front overall along a longitudinal horizontal optical axis, a reflector of the elliptical type which delimits a volume of reflection for light rays and which has a substantially elliptical surface of reflection, at least one light source which is arranged in the vicinity of a first focus of the reflector, and a convergent lens whose focal plane is arranged in the vicinity of the second focus of the reflector, the reflector having a horizontal flat surface of reflection, the upper face of which is reflective, which delimits vertically towards the bottom the volume of reflection, the flat surface of the reflector having a front end edge, referred to as the cutoff edge, which is arranged in the vicinity of the second focus of the reflector, so as to form the cutoff in the illumination beam, the flat surface of the reflector being arranged in a horizontal plane passing overall through the foci of the reflector.

According to the present invention, the flat surface of the reflector extends longitudinally towards the rear, from its cutoff edge, at least as far as the vicinity of the first focus of the reflector.

By virtue of the illumination module according to the invention, the majority of the light flux emitted by the source is used in the light beam produced by the module, with a view to implementing the associated statutory illumination function.

According to other characteristics of the invention:

- the substantially elliptical surface of the reflector is formed by an angular sector of a component substantially generated by revolution about the longitudinal optical axis, and in that this angular sector extends vertically above the flat surface of the reflector;
- the reflector is produced as a single solid component of transparent material;
- the lens is produced as a single component with the reflector;
- the light source is arranged in a complementary cavity produced in the flat surface of the reflector;
- the light source is arranged in the module so that its light diffusion axis is substantially perpendicular to the flat surface of the reflector;
- the illumination module comprises a number of adjacent light sources which are aligned overall in a substantially horizontal direction perpendicular to the longitudinal optical axis, so as to spread the illumination beam widthwise;
- the light source is a light emitting diode;
- the light source is formed by the free end of an optical fibre bundle;
- the cutoff edge of the flat surface of the reflector has a curved profile, in the horizontal plane, so as to follow overall the curvature of the focal plane of the lens;
- the horizontal flat surface of the reflector extends in a first half-plane delimited by the longitudinal optical axis, a secondary flat surface of the reflector extends in a second half-plane delimited by the longitudinal optical axis, and the secondary flat surface has a front cutoff edge which is inclined, with respect to a horizontal plane, by a given angle, so as to form an inclined cutoff in the illumination beam, with a view to producing a statutory low beam illumination beam.

The invention also relates to a vehicle illumination lamp, characterised in that it comprises at least one illumination module according to one of the preceding characteristics.

According to another characteristic of the illumination lamp according to the invention, said lamp being provided for producing a statutory low beam illumination beam, it comprises at least two illumination modules, with substantially identical structures, which are arranged substantially parallel:

a first illumination module whose cutoff edge is substantially horizontal;

and a second illumination module, which is turned by a given angle about its optical axis, with respect to the first module, so that its cutoff edge is inclined with respect to a horizontal plane, so that the illumination beams produced by the two modules are superimposed and form the statutory low beam illumination beam.

Other characteristics and advantages of the invention will emerge from a reading of the following detailed description, for the understanding of which reference should be made to the accompanying drawings, amongst which:

FIGS. 1 to 3 depict schematically an illumination module 10 which is produced in accordance with the teachings of the invention.

Figure 1:
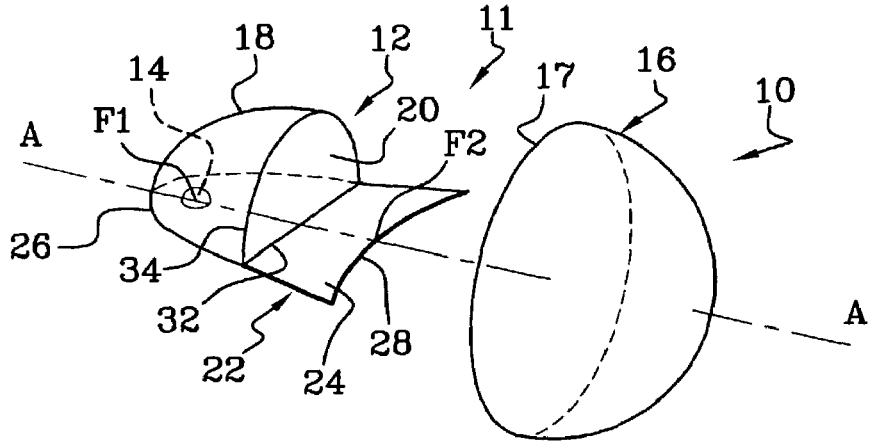
FIG. 1 is a perspective view which depicts schematically a first embodiment of the illumination module according to the invention.

Conventionally, the illumination module 10 comprises, arranged from back to front along a horizontal longitudinal optical axis A—A, a reflector 12 of the elliptical type, a light source 14 which is arranged in the vicinity of a first focus F1 of the reflector 12, and a convergent lens 16 whose focal plane is arranged in the vicinity of the second focus F2 of the reflector 12.

The reflector 12 and the lens 16 form the optical system 11 of the illumination module 10.

Figure 2:
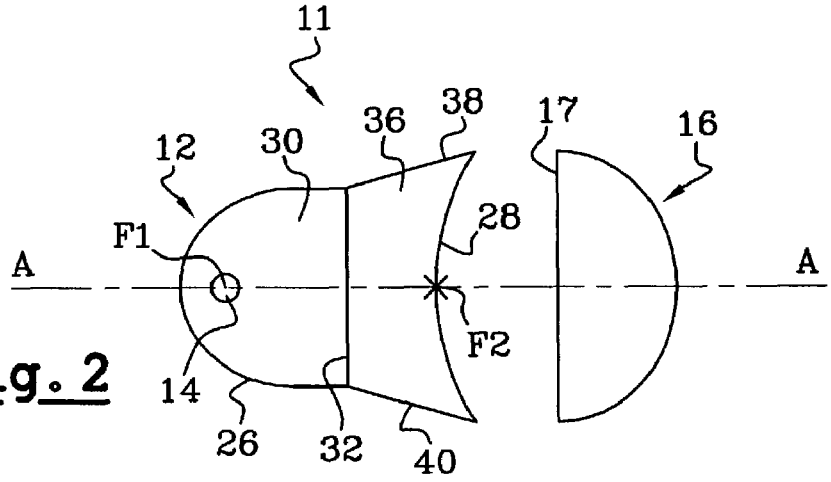
FIG. 2 is a top view which depicts schematically the illumination module of FIG. 1.
Figure 3:
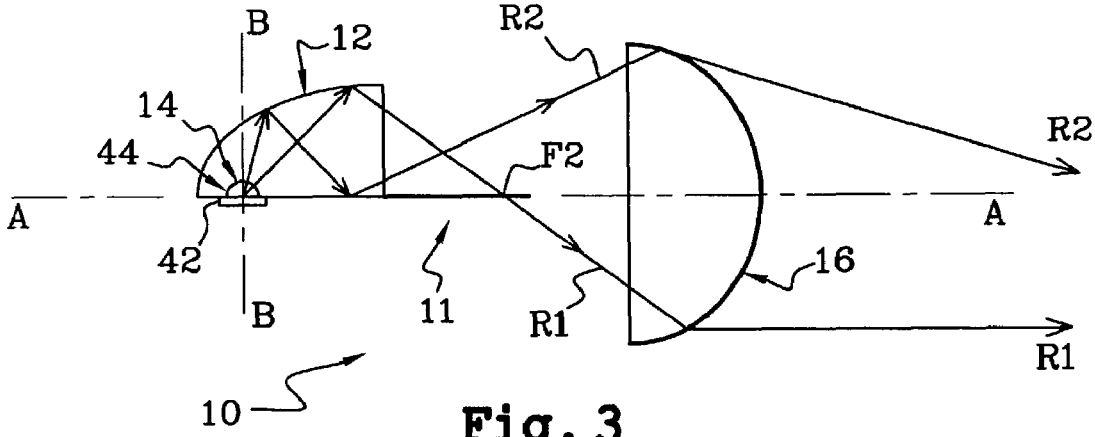
FIG. 3 is a side view which illustrates schematically the path of the light rays in the illumination module of FIG. 1.

The optical axis A—A defines here, non-limitatively, a horizontal longitudinal direction and an orientation from back to front, which corresponds to an orientation from left to right in FIGS. 2 and 3. The optical axis A—A is for example substantially parallel to the longitudinal axis of a vehicle (not depicted) equipped with the illumination module 10.

In the remainder of the description, non-limitatively, a vertical orientation which corresponds to an orientation from top to bottom in FIG. 3 will be used.

The convergent lens 16 is here a component generated by revolution about the longitudinal optical axis A—A. The lens 16 has, facing the reflector 12, a transverse input surface 17 for the light rays.

According to the embodiment depicted here, the reflector 12 has an elliptical surface 18 which is implemented in the form of an angular sector of a component substantially generated by revolution, and which extends in the half-space situated above a horizontal axial plane passing through the longitudinal optical axis A—A.

The internal face 20 of the elliptical surface 18 is reflective.

It should be noted that the elliptical surface 18 does not have to be perfectly elliptical and it can have a number of specific profiles provided for optimising the light distribution in the illumination beam produced by the module 10, according to the illumination function implemented by the module 10. This therefore implies that the reflector is not perfectly generated by revolution.

In accordance with the teachings of the invention, the reflector 12 has a horizontal flat surface 22 whose upper face 24 is reflective.

The reflector 12 delimits a volume of reflection for the light rays emitted by the source 14, that is to say a volume in which the light rays are emitted and in which the light rays are reflected. This volume of reflection is delimited, in its upper part, by the internal face of reflection 20 of the elliptical surface 18, and vertically towards the bottom by the reflective face 24 of the flat surface 22.

The flat surface 22 extends here in a horizontal axial plane.

The flat surface 22 is delimited, at the rear, at its intersection with the elliptical surface 18, by an elliptical edge 26 and, at the front, by a front longitudinal end edge 28. Provision can be made in a variant that the flat surface 22 is delimited at the rear by a right-angled segment perpendicular to the axis A—A and passing in the immediate vicinity of the source 14, and in front thereof.

The front end edge 28 of the flat surface 22 is arranged in the vicinity of the second focus F2 of the reflector 12, so as to form a sufficiently sharp cutoff in the illumination beam produced by the illumination module 10.

In the remainder of the description, this front end edge 28 will therefore be designated by "cutoff edge 28".

The focal plane of the lens 16, in a horizontal plane passing through the focus F2 of the lens 16, forms a curved profile, concave towards the front. According to embodiment, the curved shape of this profile is complex to a greater or lesser degree, and can be similar in a first approximation to an arc of a circle. Consequently, preferably, the cutoff edge 28 has a curved profile, in the horizontal plane, so as to follow overall the profile of the focal plane of the lens 16.

According to the embodiment depicted here, the reflective flat surface 22 has a semi-ellipsoidal rear section 30, which is delimited by the elliptical edge 26, and by the diameter 32 of the semi-circular front edge 34 of the elliptical surface 18.

The reflective flat surface 22 has an overall isosceles trapezoidal front section 36, which is delimited by the diameter 32 of the elliptical surface 18, by two lateral edges 38, 40, and by the cutoff edge 28.

According to the embodiment depicted here, the transverse width of the front section 36 increases progressively towards the front, so that the transverse width of the cutoff edge 28 is substantially equal to the diameter of the input surface of the lens 16.

According to a variant embodiment (not depicted) of the invention, the flat surface 22 can have only a front section 36, which extends axially towards the rear, from the cutoff edge 28 as far as a given point of the optical axis A—A situated between the first F1 and the second F2 foci of the reflector 12.

Advantageously, the light source 14 is provided for emitting its light energy in less than a "half-space" situated above the flat surface 22, and for emitting its light energy towards the internal face 20 of the elliptical surface 18.

Advantageously, the light source 14 is an encapsulated light emitting diode 44.

Light emitting diode 44 designates here the junction which produces the light energy and the light diffusion cover or case which encloses the upper part of the junction.

Conventionally, the light emitting diode 44 is mounted on an electronic support board 42, which is depicted in FIG. 3, and which is arranged here parallel under the flat surface 22.

The light emitting diode 44 has a light diffusion axis B-B which is here substantially perpendicular to the flat surface 22.

The light emitting diode 44 emits its light energy in a solid angle overall centred around its light diffusion axis B—B, and smaller than 180 degrees.

This arrangement allows the diode 44 to emit the majority of its light energy towards the internal face 20 of the elliptical surface 18.

The principle of operation of the illumination module 10 according to the invention is as follows.

It is assumed that the light source 14 is of small extent around a point coincident with the first focus F1 of the elliptical reflector 18.

Firstly, the light rays emitted by the light source 14 which pass above the cutoff edge 28, and which will be designated by primary rays R1, are considered.

As the light source 14 is arranged at the first focus F1 of the elliptical reflector 18, the major part of the primary rays R1 emitted by the source 14, after being reflected on the internal face 20 of the elliptical surface 18, is sent back towards the second focus F2 of the reflector 18, or into the vicinity thereof.

These primary light rays R1 form, at the focus F2 of the lens 16, a concentrated light image which is projected, at the front of the illumination module 10, by the lens 16, in a direction substantially parallel to the longitudinal axis A—A.

Secondly, the light rays R2 emitted by the source 14 which would pass below the cutoff edge 28, if there were no flat surface 22, and which will be designated by secondary rays R2, are considered.

These secondary light rays R2 are reflected by the internal face 20 of the elliptical surface 18 towards the reflective flat surface 22, so that they are reflected a second time towards the front.

At the time of this second reflection, the secondary light rays R2 are transmitted towards the upper part of the input surface 17 of the lens 16. Consequently, on account of its properties of convergence, the lens 16 deviates the secondary light rays R2 downwards. The secondary light rays R2 are therefore emitted under the cutoff in the illumination beam.

The closer the place of reflection on the flat surface 22 of a secondary light ray R2 is to the cutoff edge 28, and therefore to the focal plane of the lens 16, the closer the direction of this secondary light ray R2, at the output of the lens 16, is to a direction parallel to the longitudinal axis A—A.

One advantage of the illumination module 10 according to the invention is that its optical system 11 does not mask a large part of the light rays emitted by the source 14, as is the case in a conventional illumination module comprising a screen.

The reflective flat surface 22 makes it possible to "fold up" the images of the light source 14 which are reflected by the elliptical surface 18 of the reflector 12 at the second focus F2 of the reflector 12.

This is because, in the absence of the flat surface 22, certain of these images would have to straddle the limit formed by the cutoff edge 28, in a vertical plane generated by the cutoff edge 28. Each image would then comprise an upper portion situated above the cutoff edge 28 and a lower portion situated below the cutoff edge 28. By virtue of the reflective flat surface 22, the lower portion of each image is reflected upwards, as if the lower portion were folded up onto the upper portion, so that these image portions are superimposed above the cutoff edge 28, in the vertical plane generated by the cutoff edge 28.

The "fold" formed by this "folding up" of images contributes towards forming a sharp cutoff in the illumination beam projected by the lens 16.

The illumination module 10 according to the invention also has particular advantages, within the context of the use of a light emitting diode 44 as the light source 14 in an illumination module.

This is because the image of the virtual source corresponding to a diode is generally round and diffuse.

In order to produce a cutoff in an illumination beam, from an illumination module using a light source and Fresnel optics, or using a light source and a reflector of the type with a complex surface, it is necessary to align the edges of the images of the light source on the measurement screen used to validate the statutory illumination beam.

When the light source is a filament, its virtual image has overall the shape of a rectangle, so that it is relatively easy to produce a sharp cutoff by aligning the edges of the rectangles.

When the light source is a diode, it is much more difficult to produce a sharp cutoff by aligning the corresponding images, which are round in shape.

This difficulty could be surmounted by using a diaphragm with the diode, but a considerable amount of the light energy produced by the diode would then be lost.

The illumination module 10 according to the invention makes it possible to produce a sharp cutoff with a diode 44, since it projects at the front the image of a distinct edge of the optical system 11, that is to say the image of the cutoff edge 28.

The shape of the cutoff in the illumination beam is therefore determined by the profile of the cutoff edge 28, in a projection on a vertical and transverse plane.

Another difficulty for implementation of an illumination module from a diode comes from the fact that the distribution of the light energy in the light beam emitted by the diode is not homogeneous. Consequently, it is very difficult to produce a homogeneous illumination beam from direct images of the diode.

The illumination module 10 according to the invention surmounts this difficulty by exploiting a property of elliptical illumination modules which is "mixing" the images of the light source at the second focus F2 of the reflector 12, which improves the homogeneity of the illumination beam produced.

One advantage of the illumination module 10 according to the invention is that it exploits the property of encapsulated diodes 44 of emitting overall in a half-space, which makes it possible to harness over eighty percent of the light flux emitted by the diode 44, whereas, in a traditional dipped beam elliptical lamp, less than fifty percent of the light flux is harnessed.

According to a first embodiment, which is depicted schematically in FIGS. 1 to 3, the illumination module 10 is implemented by an assembly of discrete elements.

The illumination module 10 comprises, for example, an element 18 forming the elliptical part of the reflector 12, an element 22 forming the flat surface of the reflector 12, and an element 16 forming the convergent lens.

The internal face of the elliptical part 18 and the upper face of the flat surface 22 are for example coated with a reflective material.

In the case where the light source 14 is a light emitting diode 44, in view of the low heat dissipation of this type of source compared with bulbs, it is possible to produce the discrete elements in the form of polymer components, assembled for example by interlocking.

The lens 16 can be a Fresnel lens.

Figure 4:
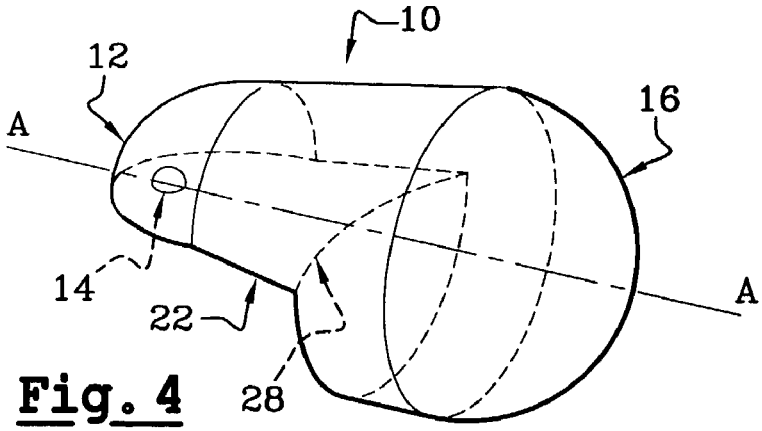
FIG. 4 is a view similar to that of FIG. 1 which depicts a second embodiment of the illumination module according to the invention.

According to a second embodiment of the invention, which is depicted schematically in FIG. 4, the optical system 11 of the illumination module 10 is produced as a single solid optical component, of transparent material, for example PMMA (polymethyl methacrylate).

The solid optical component is for example produced by moulding, or by machining.

In order to allow the reflection of the light rays emitted by the source 14 in the volume of reflection delimited by the reflector 12, the external surface of the elliptical part 18 of the reflector 12 and the external surface, here the lower surface, of the flat surface 22 of the reflector 12 are coated with a reflective material.

For certain portions of the reflector 12, the properties of total reflection in a medium with index higher than air can be used in order to bring about the reflection of the light rays in the volume of reflection delimited by the reflector 12, without using any reflective material.

According to this second embodiment, the light rays which are emitted by the light source 14 propagate inside the material constituting the optical system 11 of the illumination module 10, and then leave the optical system 11 through the front face of the convergent lens 16.

The fact that the light rays propagate inside a material, in the second embodiment, whereas the light rays propagate in air, in the first embodiment, has no notable effect on the principle of operation of the illumination module 10 according to the invention.

Advantageously, the reflective flat surface 22 has a cavity with a shape complementary to the case of the light emitting diode 44.

For example, if the case of the diode 44 has a hemispherical shape, the cavity is substantially hemispherical.

According to a variant of this second embodiment, the reflector 12 is produced as a single component of transparent material, which is distinct from the component forming the convergent lens 16.

Figure 5:
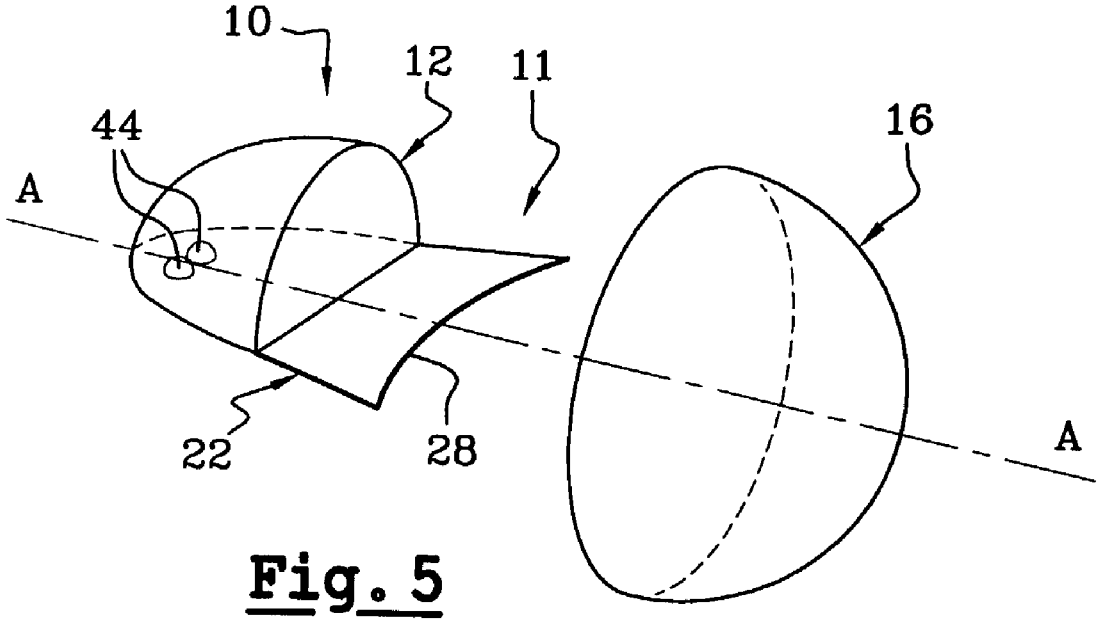
FIG. 5 is a view similar to that of FIG. 1 which depicts a variant embodiment of the illumination module of FIG. 1 comprising a number of light emitting diodes.

According to a variant embodiment of the invention, which is depicted in FIG. 5, the light source 14 can be implemented by means of a number of light emitting diodes 44.

It should be noted that the light emitting diodes 44 must be very close to one another, so that they are arranged overall at the first focus F1 of the reflector 12.

For example, in accordance with FIG. 5, two diodes 44 are aligned, advantageously in a direction perpendicular to the longitudinal optical axis A—A.

The resulting light source 14 is then equivalent to a light source spread out widthwise, since the illumination beams produced by each light emitting diode 44 overlap.

This arrangement of the diodes 44 therefore makes it possible to broaden the light beam produced by the illumination module 10.

Advantageously, in order to implement a statutory illumination function, with cutoff, for example a fog illumination function, a vehicle lamp is implemented by means of a number of identical illumination modules 10 operating simultaneously. The illumination modules 10 are arranged in parallel, that is to say their optical axes A—A are substantially parallel to one another.

Thus, the illumination beams produced by each of the illumination modules 10 are superimposed at the front of the vehicle so as to form the statutory illumination beam with cutoff.

Figure 6:
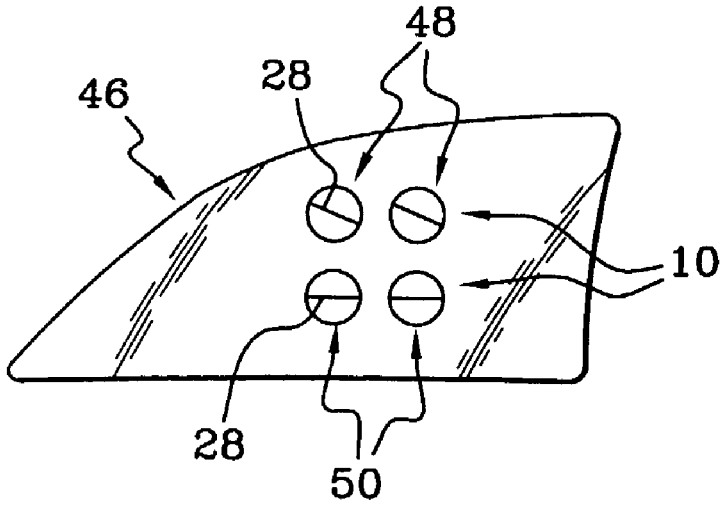
FIG. 6 is a front view which depicts schematically a vehicle illumination lamp comprising illumination modules according to the invention and producing a statutory low beam illumination beam.

By way of example, FIG. 6 depicts a vehicle lamp 46 which implements a low beam, or dipped beam, headlamp function, and which uses four identical illumination modules 10.

As the low beam illumination beam must have a cutoff having a part inclined by a given angle, for example fifteen degrees, two illumination modules 48 of the lamp 46 are turned by fifteen degrees about their longitudinal optical axis A—A, so as to produce an illumination beam having a cutoff inclined by fifteen degrees with respect to a horizontal plane.

The other two illumination modules 50 form an illumination beam having a horizontal cutoff.

The superimposition of the illumination beams produced by the four illumination modules 10 then forms a statutory illumination beam having a horizontal part and a part inclined by fifteen degrees.

Figure 7:
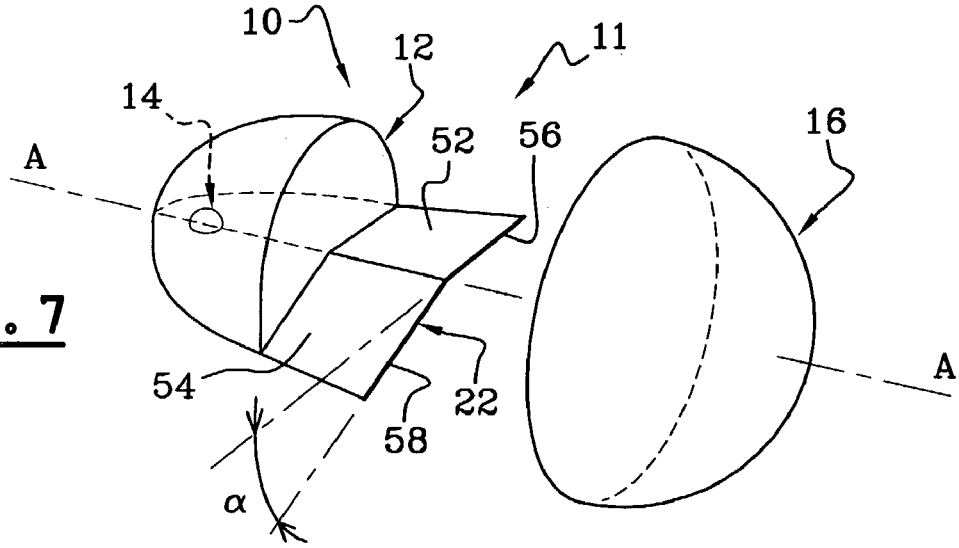
FIG. 7 is a view similar to that of FIG. 1 which depicts schematically an illumination module producing an illumination beam with cutoff corresponding to a low beam headlight.
Figure 8:
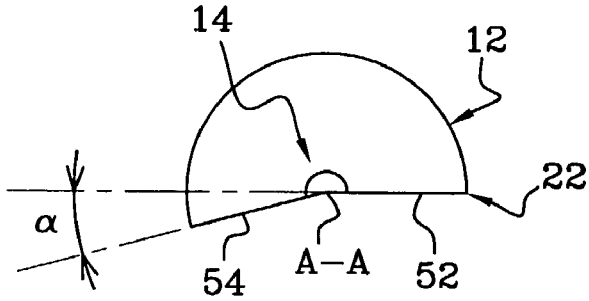
FIG. 8 is a front view which depicts the reflector of the illumination module of FIG. 7.

According to a variant embodiment of the invention, which is depicted in FIGS. 7 and 8, each illumination module 10 can be provided for producing individually an illumination beam having a cutoff in accordance with a statutory low beam headlamp beam.

According to this variant, the reflective flat surface 22 has two parts 52, 54.

A first part of the reflective surface 22 extends in a first half-plane 52 delimited by the longitudinal optical axis A—A, and which extends to the right in FIG. 8.

This first half-plane 52 is contained in the horizontal plane. Its cutoff edge 56 is therefore horizontal, so that it produces the horizontal part of the cutoff in the illumination beam produced by the module 10.

The reflective flat surface 22 has a second reflective part 54 which extends in a second half-plane, delimited by the longitudinal optical axis A—A, and this secondary flat surface 54 has, at the front, a cutoff edge 58 which is inclined, with respect to the horizontal plane, by a given angle $\alpha$, for example fifteen degrees.

According to a variant embodiment (not depicted) of the invention, the light source 14 can be formed by the free end of an optical fibre bundle.

One drawback of optical fibres is that they form a light source having a luminous core and a dark ring, due to the cladding surrounding the core of the fibre.

This type of light source, when used in a vehicle illumination lamp using for example a reflector of the type with a complex surface, therefore forms, in the illumination beam, images in the form of pixels surrounded by a dark area, due to the cladding.

One advantage of the illumination module 10 according to the invention is that it makes it possible to mix all the images of the light source 14 at the second focus F2 of the reflector 12, so that there are no pixels of the optical fibre in the illumination beam.

What is claimed is:

1. An illumination module for a motor vehicle lamp producing an illumination beam of the type with cutoff, comprising, arranged from back to front overall along a longitudinal horizontal optical axis (A—A), a reflector of the elliptical type which delimits a volume of reflection for light rays and which has a substantially elliptical surface of reflection, at least one light source which is arranged in the vicinity of a first focus of the reflector, and a convergent lens whose focal plane is arranged in the vicinity of the second focus of the reflector, the reflector having a horizontal flat surface of reflection with an upper face which is reflective, which delimits vertically towards the bottom the volume of reflection, the flat surface of the reflector having a front end edge, referred to as the cutoff edge, which is arranged in the vicinity of the second focus of the reflector, so as to form the cutoff in the illumination beam, the flat surface of the reflector being arranged in a horizontal plane passing overall through the focus of the reflector, wherein the flat surface of the reflector extends longitudinally towards the rear, from its cutoff edge, at least as far as the vicinity of the first focus of the reflector.

2. An illumination module according to claim 1, wherein the substantially elliptical surface of the reflector is formed by an angular sector of a component substantially generated by revolution about the longitudinal optical axis (A—A), and wherein this angular sector extends vertically above the flat surface of the reflector.

3. An illumination module according to claim 2, wherein the reflector is produced as a single solid component of transparent material.

4. An illumination module according to claim 3, wherein the lens is produced as a single component with the reflector.

5. An illumination module according to claim 3, wherein the light source is arranged in a complementary cavity produced in the flat surface of the reflector.

6. An illumination module according to claim 1, wherein the light source is arranged in the module so that its light diffusion axis (B—B) is substantially perpendicular to the flat surface of the reflector.

7. An illumination module according to claim 1, comprising a plurality of adjacent light sources which are aligned overall in a substantially horizontal direction perpendicular to the longitudinal optical axis (A—A), so as to spread the illumination beam widthwise.

8. An illumination module according to claim 1, wherein the light source is a light emitting diode.

9. An illumination module according to claim 1, wherein the light source is formed by the free end of an optical fiber bundle.

10. An illumination module according to claim 1, wherein the cutoff edge of the flat surface of the reflector has a curved profile, in the horizontal plane, so as to follow overall the curvature of the focal plane of the lens.

11. An illumination module according to claim 1, wherein the horizontal flat surface of the reflector extends in a first half-plane delimited by the longitudinal optical axis (A—A), wherein a secondary flat surface of the reflector extends in a second half-plane delimited by the longitudinal optical axis (A—A), and wherein the secondary flat surface has a front cutoff edge which is inclined, with respect to a horizontal plane, by a given angle ($\alpha$), so as to form an inclined cutoff in the illumination beam, with a view to producing a statutory low beam illumination beam.

12. A vehicle illumination lamp comprising at least one illumination module according to claim 1.

13. An illumination lamp according to claim 12, of the type which is provided for producing a statutory low beam illumination beam, comprising at least two illumination modules, which are arranged substantially parallel to one another each module including:

a first illumination module whose cutoff edge is substantially horizontal;

and a second illumination module, which is turned by a given angle about its optical axis (A—A), with respect to the first module, so that its cutoff edge is inclined with respect to a horizontal plane, so that the illumination beams produced by the two modules are superimposed and form the statutory low beam illumination beam.

14. An illumination module according to claim 4, wherein the light source is arranged in a complementary cavity produced in the flat surface of the reflector.

* * * * *